US006138383A

United States Patent [19]

Steinke et al.

[11] Patent Number: 6,138,383

[45] Date of Patent: Oct. 31, 2000

[54] SHOE INSERT

[76] Inventors: Richard A. Steinke, 1580 Bermuda Dunes Dr., Boulder City, Nev. 89005; Vincent F. Panaroni, 369 Town Farm Rd., Springfield, N.H. 03284; Todd W. Hooks, 12939 SE. 246$^{th}$ St., Kent, Wash. 98031

[21] Appl. No.: 09/370,174

[22] Filed: Aug. 9, 1999

[51] Int. Cl.$^{7}$ ..... A43B 13/38

[52] U.S. Cl. ..... 36/44; 36/141; 36/29; 36/3 R

[58] Field of Search ..... 36/43, 44, 3 R, 36/3 B, 140, 166, 181, 141, 146, 29

[56] References Cited

U.S. PATENT DOCUMENTS

| | | | |
|---|---|---|---|
| 1,044,015 | 11/1912 | Byrne | 36/29 |
| 1,320,364 | 10/1919 | Boone | 36/146 |
| 1,676,415 | 7/1928 | Saperston | 36/146 |
| 4,831,749 | 5/1989 | Tsai | 36/3 B |
| 4,999,931 | 3/1991 | Vermeulen | 36/29 |
| 5,035,068 | 7/1991 | Biasi | 36/3 R |
| 5,042,175 | 8/1991 | Ronen et al. | 36/28 |
| 5,799,413 | 2/2000 | Argyris | 36/43 |
| 6,006,448 | 12/1999 | Hellman | 36/11.5 |
| 6,029,962 | 2/2000 | Shorten et al. | 267/145 |

*Primary Examiner*—Paul T. Sewell
*Assistant Examiner*—Jila Mohandesi
*Attorney, Agent, or Firm*—M. Reid Russell

[57] ABSTRACT

The invention in a shoe insert to be fitted into and maintained in a conventional walking or running shoe to provide support and cushioning to the foot of such shoe wearer. The shoe insert is to fit into a shoe to grip to the shoe insole and is manufactured from a vio-elastic polyperic material having a recovery or compression set less than two (2) percent providing a rapid rate of force dissipation to a shoe wearer that is equal to their rate of gait, with further cushioning provided by a selection and formation of cavities in the insert surface that is in engagement with a shoe insole. The cavities preferably consist of spaced dome and cylindrical shaped cavities, with the dome shaped cavities spaced apart and located over points of greatest anticipated stress concentrations as the shoe wearer experiences during walking or running, each to partially collapse, expanding outwardly within the polymeric material to where a lower edge of each also expands outwardly, providing an absorbtion of force with a rapid rebound when the force is removed, providing a dampening spring action, with the spaced cylindrical cavities also included in the shoe insert that are each formed to have approximately half the volume of a dome shaped cavity, and are positioned adjacent to points of lesser anticipated stress concentrations and around the insert outer edge, that are each to collapse inwardly around a center portion such that edges thereof flex outwardly, providing a cushioning while prohibiting an outward creep of the insert material.

7 Claims, 3 Drawing Sheets

SHOE INSERT

BACKGROUND OF THE INVENTION

1. Field of the Invention

This invention relates to inserts for fitting into a conventional dress or athletic shoes for providing cushioning between the sole of the shoe wearer's foot and the shoe insole, and in particular to resilient shock absorbing shoe inserts, and the like.

2. Prior Art

Shoe inserts are, of course, well known and include cushioning insoles as well as insoles impregnated with chemicals for treating foot diseases, foot fungus, and the like, and have heretofore involved a use of polymeric materials in their fabrication. Such have not, however, included an insole design for incorporation into an engineered polymer that is like that of the present invention. Where earlier shoe inserts have generally been formed as a flat or slightly curved section of material cut from a flexible pad or sponge type material to conform to and fit within a shoe, such have relied only upon the elastic or rebound characteristics of the selected pad or sponge material to provide cushioning and foot protect. The present invention involves both a modern polymeric material that is selected to provide desired cushioning and rebound characteristics and additionally provides an arrangement of spaced cavities formed in the insert surface opposite to the shoe sole where individual cavities will flex to absorb and dissipate shock forces directed therein with the shapes of cavities specifically selected to provide a desired flexure and rebound for a particular location on the wearer's foot where stress concentrations are expected. For example, the cavities at the ball and along the outer edge of the foot are cylindrical cavities formed to have approximately half the area of other adjacent dome shaped cavities to absorb, without unwanted outward collapse, forces as the wearer's foot experiences in walking and running.

SUMMARY OF THE INVENTION

It is a principal object of the present invention to provide a shoe insert for convenient fitting as an insert in a conventional dress or athletic shoe to cushion a wearer's foot against forces directed through the shoe sole during walking and running.

Another object of the present invention is to provide a shoe insert formed from a selected polymeric material having a desired vio-elastic character where the insert material will exhibit nearly a complete recovery after removal of the compressive force, exhibit two (2) percent or less compression set only.

Another object of the present invention is to provide a shoe insert that includes a non-slip gripping surface as a characteristic of the polymer selected for its manufacture that engages the shoe insole, prohibiting movement of the insert within the shoe during shoe wear.

Another object of the present invention is to provide a shoe insert formed from a polymeric material that will quickly and efficiently dissipate shock forces directed through the shoe sole to the surrounding area, with the insert to then quickly rebound to its initial attitude.

Another object of the present invention is to provide a shoe insert formed with spaced cavities in the shoes insole engaging surface whose shapes are selected for affording to the shoe wearer maximum flexure at a point of shock concentration without collapse and to provide efficient rebound.

Still another object of the present invention is to provide a shoe insert whose spaced cavities are individually formed to provide an area or volume relationship to one another such that cavities located at higher stress concentration point have a less volume than those where less force concentrations are anticipated to provide shock absorbency while supporting the insert material against outward creep.

Still another object of the present invention is to provide a shoe insert whose cavities at points of anticipated higher stress or force concentrations will have volumes that are approximately half the volume of cavities located at points of lesser force concentrations.

Still another object of the present invention is to provide designed and engineered cavities to the shoe insert that are located in areas of anticipated stress concentrations to obtain same or better compression properties as a solid section of the selected vio-elastic material would exhibit.

Still another object of the present invention is to provide a shoe insert that can be quickly installed in and removed from a shoes and can be easily and efficiently washed as in a conventional washing machine.

The invention is in a shoe insert that is shaped to conform to a shoe insole and is thin and bendable to be easily installed therein. The insert of the invention is formed from a polymer material compound of selected to have a molecular weight of from one thousand (1,000) up to and including six thousand (6,000), which compound is preferably made up of polymers of a diol or two (2) functionally, or a triol or three (3) functionally, or a combination of diols and/or triols. The compound preferably includes a chain extender or cross linking polyol having, preferably, ;a molecular weight in a range of from sixty (60) to six hundred (600), employs a catalyst that is preferably an amine such as one used in combination with a heavy metal catalyst such as iron, tin, lead or the like; and includes as an isocyanate Methylene Diisocyanate (MDI), having an isocyanate equivalent of from one hundred twenty five (125) to three hundred (300), or the like, and provides a vio-elastic polymer having rapid and nearly perfect recovery after compression the has a non-slip surface character to provide a sure gripping action to a shoe insole. The insert preferably includes a soft cloth upper surface covering that a wearer's foot is in contract with. The insert is formed to include, in its shoe insole engaging surface, a number of strategically placed cavities whose positioning and area or volume is selected for the force or forces, also herein identified as points of stress concentration, that the insert is expected to be subjected to at each location. In practice, cavities located at points of high anticipated stress concentration have areas or volumes that are approximately half the area or volume of cavities located at points of lesser anticipated stress concentrations. With the insert areas adjacent to the outer edge arranged with cavities to both cushion and preclude an outward creep thereof, maintaining the insert shape during use.

BRIEF DESCRIPTION OF THE DRAWINGS

These and other object of the present invention will become more fully apparent from the following description in which the invention is describe in detail in conjunction with the accompanying drawings.

DETAILED DESCRIPTION OF THE INVENTION

Figure 1:
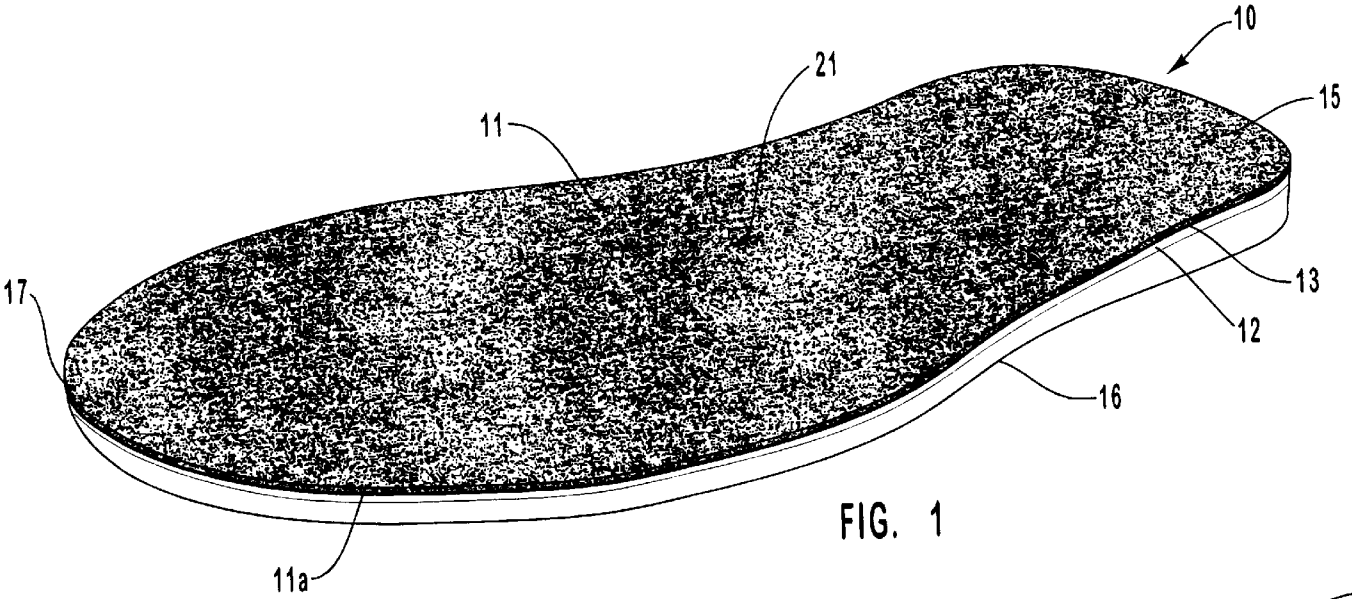
FIG. 1 is a top plan from a left side elevation perspective view of a shoe insert of the invention.

Referring now to the drawings:

FIG. 1 shows a perspective view taken from the insert top left side shoe insert 10 of the invention, showing the insert as including a top pad section 11, that is preferably formed from a soft cloth material, or the like, and is to receive a shoe wearer's foot positioned thereon. The pad section 11 is attached, as by gluing, or the like, shown as layer 11*a* in FIGS. 1,2, and 4 through 7A, onto a top face 13 of a cushion foot support 12 of the shoe insert. The pad section 11 and cushion foot support 12 are identically cut around their outer edge in the shape of a foot to conveniently fit into a shoe.

The shoe insert 10 is preferably installed by laterally rolling it upon itself forming a roll around its longitudinal axis and inserting it toe end first, into a shoe, not shown. In the shoe, the insert 10 will flatten to its original shape, fitting over the shoe insole, after it is fully inserted into the shoe. So arranged, an insert bottom face 14 fits snugly to the shoe insole and provides a non-slip adherence thereto. This non-slip adherence is achieved by a selection of a polymer material that will exhibit both flexure and resiliency that is also somewhat tacky to grip to the shoe insole surface. In practice, a polymer material having a vio-elastic nature that exhibits nearly a perfect (less than two (2) percent of an applied force is not cushioned) recovery or compression set is preferred and a vio-elastic material that is an elastomer polymer compound of OH (hydroxyl) containing polymers that are reacted with an NCO such as Methylene Diisocyanate containing isocyanates and has been found to provide the desired tacky surface consistency and exhibit a preferred vio-elastic nature or character for manufacture of the shoe insert 10 has been used in practice.

A shoe insert 10 that includes a cushion foot support 12 preferably manufactured from a polymer material, as described above, and whereto a top pad section 11, that is preferably a soft flexible cloth material, or the like, is attached, is thereby provided that can easily be installed in a shoe, to grip the shoe insole and, when dirty, can be removed by pulling the insert out of the shoe for washing, in a conventional washing machine and is then reinstalled in the shoe. In which washing, due to the inherent tacky character of the preferred polymer material, the insert 10 bottom surface will retain its gripping characteristics, allowing is to stick to and resist slipping over the shoe insole when reinstalled.

The shoe insert 10, is installed in a shoe that can be a dress or athletic shoes, as describe above, to cushion the shoe wearer's foot during walking or running, combining both the described preferred material the insert is manufactured from, and preferably has a greater thickness at the heel end 15 to taper uniformly to a shoe the instep portion 16, and therefrom has a uniform thickness to a toe end 17. Additional to a utilization a selected preferred material and its design with a thicker material at the heel area an anticipated point of high stress concentration, the insert 10 further includes a unique arrangement of cavities formed in the insert bottom face 14 that is opposite to and is in contact with the shoe insole. The combination of the selected material and cavities to provide a spring act at a point of impact or applied force, with the cavity to individually act to absorb energy and rebound, exhibiting, as set out above, a recovery that is nearly perfect, having a compression set of less than two (2) percent. The combination of the engineered polymer and the engineered holes and their location provide the necessary support and comfort that enables the user to not suffer from the effects of heel strike and foot pronation and the force and impact associated with normal foot movements in walking or running. Further, the compressive strength and the extremely low compression set properties of the compounded polymers with yield to the user, with maximum comfort obtained through these specific compounds, designs, and their placement within the shoe insert unit itself.

In walking, a shoe wearer's heel area is, of course, subjected to a greater shock than the ball or toe area as the walker strides along, their heel initially contacting a surface with the shoe rotated forward therefrom. During running, however, it is the toe area adjacent to insert end 17 and ball of their foot, shown as area 17*a*, may be the part of the foot that first contacts the surface, and is accordingly subjected to shock forces as the foot contacts a surface. Accordingly, the insert 10 of the invention anticipates that these areas, at the heel and ball of the foot, and at the toe area, will need a greater cushioning. It is in these areas, therefore, as shown best in FIGS. 2 and 3, that an effective cushioning and rapid rebound is most desirable. Therefore, the insert 10 of the invention, at these locations, includes dome shaped cavities 18 and 20, respectively.

Figure 3:
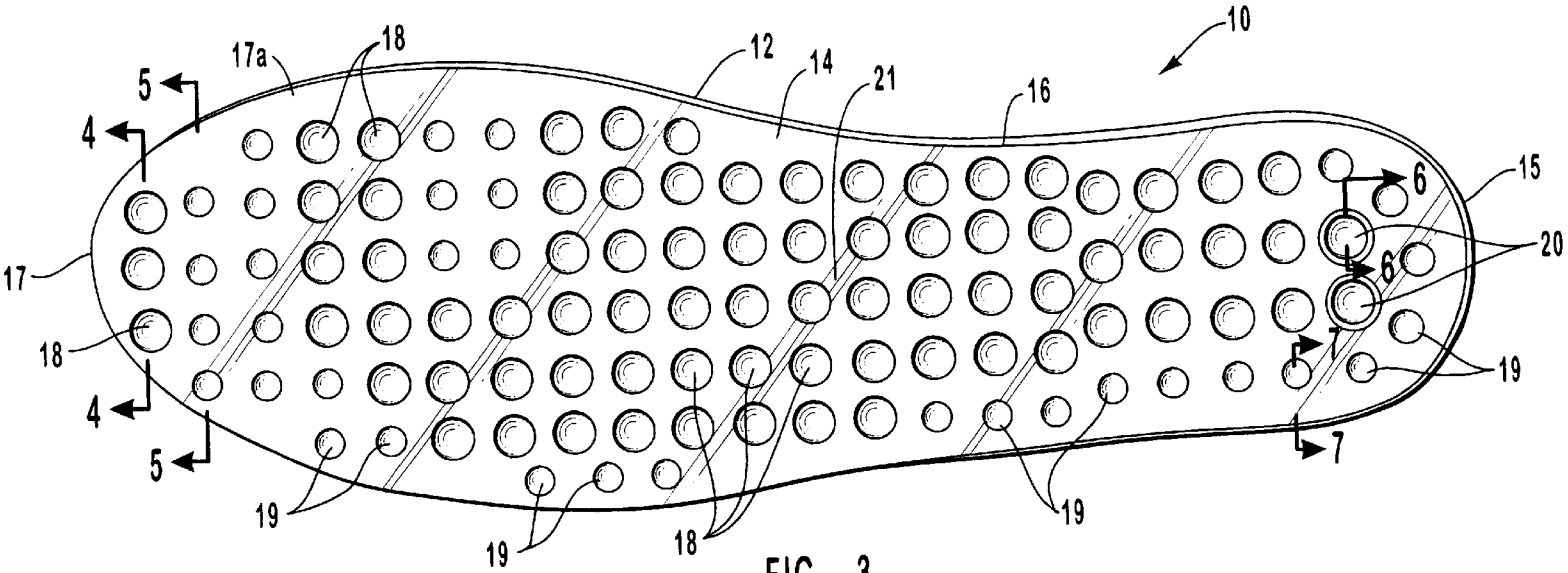
FIG. 3 is a bottom plan view of the shoe insert of FIG. 2, showing the spaced cavities as includes essentially cylindrical cavities formed into the insert adjacent to the insert sides., along points of stress concentration as the insert is subjected to, with dome shaped cavities, that are approximately twice the volume or area of the cylindrical cavities, formed at spaced intervals across the insert bottom face, spaced apart from the cylindrical cavities.
Figure 5:
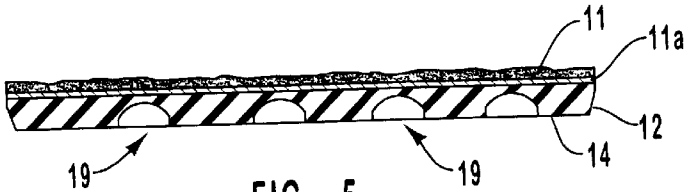
FIG. 5 is an enlarged sectional view taken along the line 5—5 of FIG. 3.
Figure 5A:
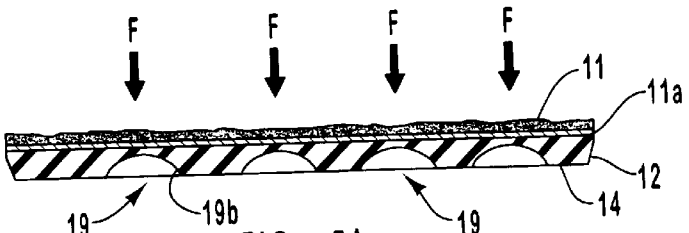
FIG. 5A is a view like that of FIG. 5 additionally showing spaced arrows identified with the letter F indicating forces being directed into the insert.
Figure 4:
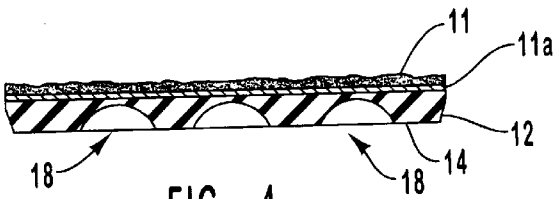
FIG. 4 is an enlarged sectional view taken along the line 4—4 of FIG. 3.
Figure 4A:
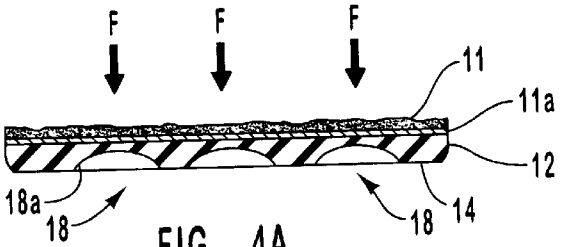
FIG. 4A is a view like FIG. 4 additionally showing spaced arrows identified with the letter F indicating forces being directed into the insert.

The respective dome shaped cavities 18 and 20 are similar, with the cavities 18 shown in the ball of the foot 17*a* and toe 17 areas of the insert 10 having a half spherical top end and. are smooth walled to a lower or bottom end 18*a*, as shown in FIG. 4, that is an enlarged sectional view of a section of dome shaped cavities 18 located in the area of the insert toe 17. Which cavities 18 are arranged across the ball of the foot 17*a* area of the insert 10, as shown in FIG. 3, and the cavities 20, as shown best in FIG. 6, each include half spherical top ends and have smooth walls but are flared outwardly at 20*a*, away from the plane of the cavity smooth wall, forming a skirt that terminate in a lower edge 20*b*. So arranged, when a force, shown as arrow F in FIG. 4A, is directed into the insert 10 top surface 11, the skirt portion of the cavity 20 below the transition 20*a* tends to flex outwardly at its edge 20*b*, with the dome 20 wall tending to somewhat collapse, with the area of the insert 12 around the cavity 20 thereby absorbing the force F. The resiliency of the selected insert material and cavity shape to return the cavity 20 to its original attitude, after removal of that force F. Similarly, a force F directed into the insert 10 top surface 11, as shown in FIG. 4A, will tend to collapse each affected cavity 18, spreading a lower edge 18*a* thereof and then rebounding to its original configuration when the force is removed. Both the dome shaped cavities 18 and 20 therefore are to provide a cavity compression upon experiencing force F that is directed therein, and to rebound upon removal of that force, cushioning the shoe wearer's foot.

Figure 2:
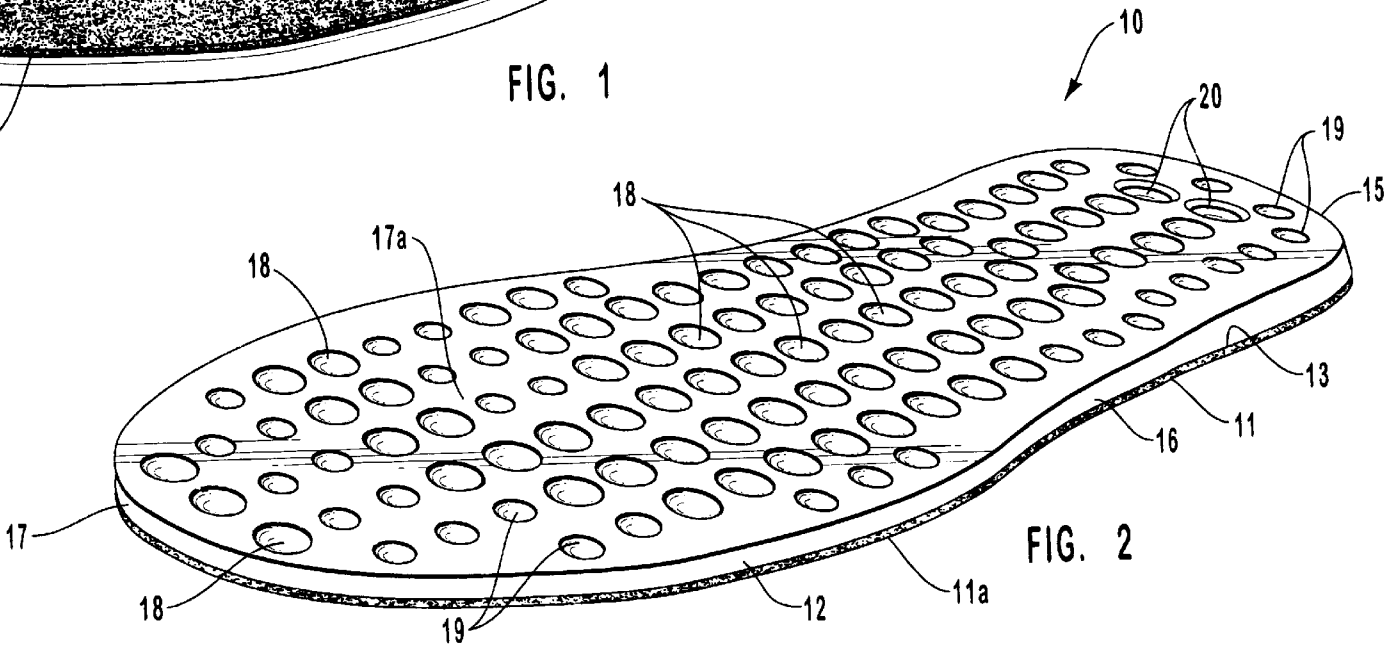
FIG. 2 is a bottom plan perspective view of the shoe insert of FIG. 1 showing insert bottom face as including a plurality of spaced cavities formed therein.

Shown is FIGS. 2 and 3, the dome shaped cavities 18 are includes, at spaced intervals, from the ball area 17*a* of the wearer's foot, across a mid section 21, to the heel 15 area, where cavities 20 are formed. So arranged, the cavities 18 provide a cushioning to the wearer's foot between points of greatest anticipated stress concentration, as set out above, cushioning the wearer's foot for comfort during walking or running, and further providing for a reduction in volume of material in the cushion foot support 12 to markedly reduce the weight of insert 10.

Additional to the dome shaped cavities 18 and 20, respectively, the cushion foot support 12 includes cylindrical cavities 19 that are shown arranged alongside and adjacent to the cavities 18 and 20 at the points of lesser anticipated stress concentration, and along the sides, around the heel 15 and across the area of toe 17, back from toe dome shaped cavities 18. The cylindrical cavities 19 preferably also include half spherical top ends with a smooth side wall, with the side wall intersecting the insert bottom surface 14 at approximately a right angle. The cylindrical cavities 19 are of lesser volume or area, approximately half the volume or area of, the dome shaped cavities 18, and are both for providing side support to the cushion foot support 12 and insert weight reduction, discouraging an outward creep of the support 12 material when forces F are directed therein.

Figure 7:
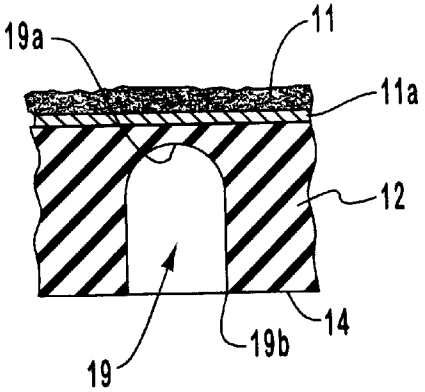
FIG. 7 is an enlarged sectional view taken along the line 7—7 of FIG. 3 showing a single cylindrical shaped cavity between the dome shaped cavity and the other edge of the shoe insert.
Figure 7A:
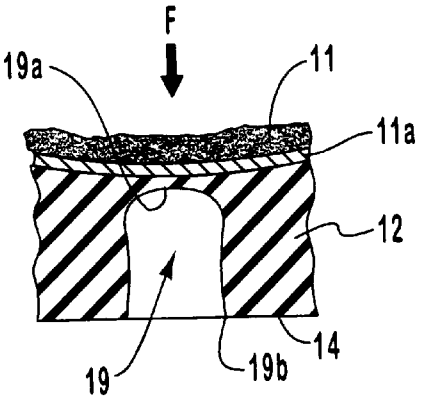
FIG. 7A is a view like that of FIG. 7 additionally showing an arrow identified with the letter F indicating a force being directed into the insert, acting upon the cylindrical shaped cavity to partially collapse the cylindrical cavity inwardly and spread its lower edge inwardly.
Figure 6:
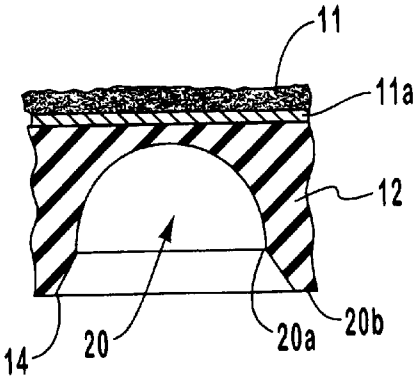
FIG. 6 is an enlarged sectional view taken along the line 6—6 of FIG. 3 showing a single dome shaped cavity located in the heel area of the shoe insert.
Figure 6A:
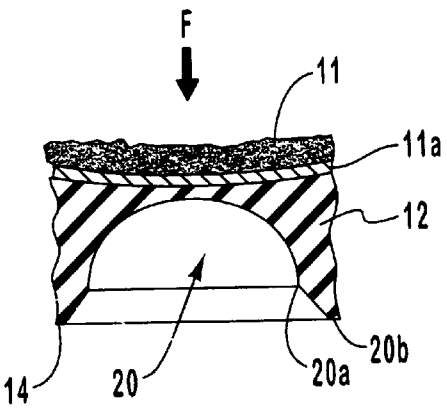
FIG. 6A is a view like that of FIG. 6 additionally showing an arrow identified with the letter F indicating a force being directed into the insert, acting upon the dome shaped cavity to partially collapse the cavity and spread a lower edge thereof.

In FIGS. 2 and 3, and the expanded side elevation sectional views of FIGS. 7 and 7A, the support 12 is shown as including the cylindrical cavities 19 having somewhat half spherical rounded tops or inner top ends and are straight walled therefrom to lower edges 19*b*. Cylindrical cavities 19 are shown in FIG. 7A being subjected to force F causing the straight walls thereof to flex inwardly, in absorbing force F, each providing a minimum of outward creep to lower edges 19*b*. The cylindrical cavity 19 will rebound when the force F is removed to return to its original attitude, as shown in FIG. 7. So arranged, the cylindrical cavities 19 tend absorb forces introduced therein while essentially retaining the support 12 material shape and thickness, cooperating with the dome shaped cavities 19 and 20, to effectively dampen shock forces as are introduced into the support material 12 and to reduce insert 10 weight. In practice, as set out above, the volume of a cylindrical cavity 19 is preferably approximately half that of a dome shaped cavity 18, with the volume or area of each of the dome shaped cavities 20 being essentially the same as or only slightly greater than a dome shaped cavity 18. This cavity volume or area relationship, should be understood, however, from a practice of the invention, can be up to twenty (20) percent greater or lesser than the above set out relationship and still provide the described force dissipation while minimizing outward creep or flexure of the support 12 material, and still be within the scope of this disclosure.

While a preferred embodiment of the shoe insert of the invention has been shown and described herein as preferred, it should be understood that the present disclosure is made by way of example only and that variations to the shoe insert and its use are possible within the scope of this disclosure without departing from the subject matter coming within the scope of the following claims, and a reasonable equivalency thereof, which claims we regard as our invention.

We claim:

1. A shoe insert comprising, a section of a vio-elastic material selected to provide a recovery action that is equal to the rate of impact generated by forces applied to the shoe insert to dissipate said forces and rebound to its original shape, which said section of polymeric material is cut to the shape of a shoe insole, has essentially flat top and bottom surfaces, includes a flat section of a soft material bonded to said top surface thereof and further includes, formed in said bottom surface thereof, a plurality of cavities, the shapes of which cavities, respectively, to be dome and cylindrical shaped with each said dome shaped cavity to have a volume that is approximately twice the volume or area each said cylindrically shaped cavity, plus or minus twenty (20) percent, and with a number of said dome shaped cavities formed in said polymeric material at points of greatest anticipated stress concentration and with a number of said cylindrical cavities formed adjacent to and around said insert edge.

2. A shoe insert as recited in claim 1, wherein the vio-elastic material is selected to present a slightly tacky surface for gripping to a shoe insole.

3. A shoe insert as recited in claim 2, wherein the vio-elastic material is a compound of OH (hydroxyl) containing polymers that are reacted with an NCO containing isocyanates.

4. A shoe insert as recited in claim 1, wherein both the dome shaped and cylindrical cavities have rounded top end surfaces, with said dome shaped cavity wall uniformly sloping outwardly to an outer edges and with said cylindrical cavity wall forming a right angle to the insert bottom surface.

5. A shoe insert as recited in claim 4, wherein some of the dome shaped cavities walls are uniformly sloped to an intersection within the insert material whereat the angle of slope is increased to intersect the insert bottom surface, forming a lower skirt section.

6. A shoe insert as recited in claim 1, wherein the insert is formed to have a greater thickness across a heel area, to slope uniforming therefrom to an insert instep section, and has a uniform thickness from said instep section to an instep toe end.

7. A shoe insert as recited in claim 1, wherein the selected section of polymeric material is one that has been engineered and compounded to provide a memory that allows the article to respond at a same rate as a rate that the energy has been put into said polymer, eliminating return shock or flattening such that the return rate is too slow to where a full recovery is not achieved before new forces are inputted into the article, prohibiting the insert from returning to its natural and/or full size and/or dimensions.

* * * * *